US006209999B1

(12) United States Patent
Wen et al.

(10) Patent No.: US 6,209,999 B1
(45) Date of Patent: Apr. 3, 2001

(54) PRINTING APPARATUS WITH HUMIDITY CONTROLLED RECEIVER TRAY

(75) Inventors: Xin Wen; Charles E. Romano, Jr.; Henry G. Wirth, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/219,694

(22) Filed: Dec. 23, 1998

(51) Int. Cl.[7] ..... B41J 2/01
(52) U.S. Cl. ..... 347/104; 347/102
(58) Field of Search ..... 347/104, 101, 347/99, 102, 103, 16, 17, 7; 101/487; 400/690.4, 691, 693

(56) References Cited

U.S. PATENT DOCUMENTS

| | | | | |
|---|---|---|---|---|
| 3,946,398 | | 3/1976 | Kyser et al. . | |
| 4,723,129 | | 2/1988 | Endo et al. . | |
| 5,013,603 | * | 5/1991 | Ogawa et al. | 428/331 |
| 5,519,428 | * | 5/1996 | Van Peteghem | 347/215 |
| 5,552,818 | * | 9/1996 | Agano et al. | 347/133 |
| 5,651,625 | * | 7/1997 | Smith et al. | 400/691 |
| 5,823,695 | * | 10/1998 | Bock | 400/642 |
| 5,988,787 | * | 11/1999 | Watanabe et al. | 347/22 |
| 6,033,050 | * | 3/2000 | Morita et al. | 347/23 |

FOREIGN PATENT DOCUMENTS

| | | |
|---|---|---|
| 827 833 A2 | 7/1997 | (EP) . |
| 98/08687 | 8/1997 | (WO) . |

* cited by examiner

*Primary Examiner*—John S. Hilten
*Assistant Examiner*—Darius N. Cone
(74) *Attorney, Agent, or Firm*—Peyton C. Watkins

(57) ABSTRACT

Apparatus for forming an image on a receiver in response to a digital image includes print heads for transferring colorant to the receiver. The receivers are stored in a receiver supply device in a humidity controlled environment. A receiver transport mechanism moves the receiver to a position where the print heads transfer colorant to the receiver to form an image on the receiver.

9 Claims, 6 Drawing Sheets

PRINTING APPARATUS WITH HUMIDITY CONTROLLED RECEIVER TRAY

FIELD OF THE INVENTION

The present invention relates to methods and apparatus for providing high quality ink images on a receiver.

BACKGROUND OF THE INVENTION

Ink jet printing has become a prominent contender in the digital output arena because of its non-impact, low-noise characteristics, and its compatibility with plain paper. Ink jet printing avoids the complications of toner transfers and fixing as in electrophotography, and the pressure contact at the printing interface as in thermal resistive printing technologies. Ink jet printing mechanisms include continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. EP 827 833 A2 and WO 98/08687 disclose a piezoelectric ink jet print head apparatus with reduced crosstalk between channels, improved ink protection, and capability of ejecting variable ink drop size.

U.S. Pat. No. 4,723,129, issued to Endo et al, discloses an electrothermal drop-on-demand ink jet printer which applies a power pulse to an electrothermal heater which is in thermal contact with water based ink in a nozzle. The heat from the electrothermal heater produces vapor bubble in the ink, which causes an ink drop to be ejected from a small aperture along the edge of the heater substrate. This technology is known as Bubblejet™ (trademark of Canon K.K. of Japan).

One problem related to ink jet printing is related to insufficient drying of the ink of the ink droplets that are placed on the ink receiver during or after printing. In the field of ink jet printing, the term "drying" typically refers to drying through evaporation as well as drying by absorption of ink fluid into the receiver. For color and photographic printing, it is often desirable to coat an ink absorption layer on the receiver to assist the ink absorption. When ink drops are not dried fast enough, several image artifacts can occur. One type of image artifact is called coalescence, that is, wet ink drops on the receiver paddled together and causes a glossiness change in the area of the ink paddle. The insufficient drying can also cause wet ink of one color on the receiver to diffuse into the ink area of a different color, which produces a "color bleeding" image artifact.

Another problem related to the above is that the image quality and other ink jet printing performance are often sensitive to the environment variation. One cause for this problem is that the relative humidity in the environment affects the amount of the moisture stored in the receiver. With high moisture content, the ability of the ink absorption by the receiver is reduced. The drying rate of ink drops on receiver is decreased. A receiver with high moisture content can also affect how accurately the receiver can be transported. The receiver driving rollers can slip at the interface between the roller and the receiver surface.

SUMMARY OF THE INVENTION

An object of this invention is to provide a printing apparatus having improved image quality.

A further object of this invention is to provide a printing apparatus that provides robust performance in different ambient environment.

An additional object of the present invention is to improve the drying of ink on the receiver so that printing productivity is increased.

These objects are achieved by apparatus for forming an image on a receiver in response to a digital image, comprising:

a) print head means responsive to the digital image for transferring colorant to the receiver;

b) receiver supply device for storing the receiver(s) in a humidity controlled environment; and, c) receiver transport mechanism for moving the receiver to a position where the print heads can transfer colorant to the receiver to form an image on the receiver.

ADVANTAGES

An advantage of this invention is that the variability of the printing performance is reduced relative to changes in the ambient environment.

Another advantage of this invention is that the drying of ink drops on receiver is increased so that printing productivity is increased.

A further advantage of this invention is that the probability for image artifacts is reduced.

DETAILED DESCRIPTION OF THE INVENTION

The present invention is described with relation to a digital printing apparatus including the treatment the receiver for enhanced image structure.

Figure 1:
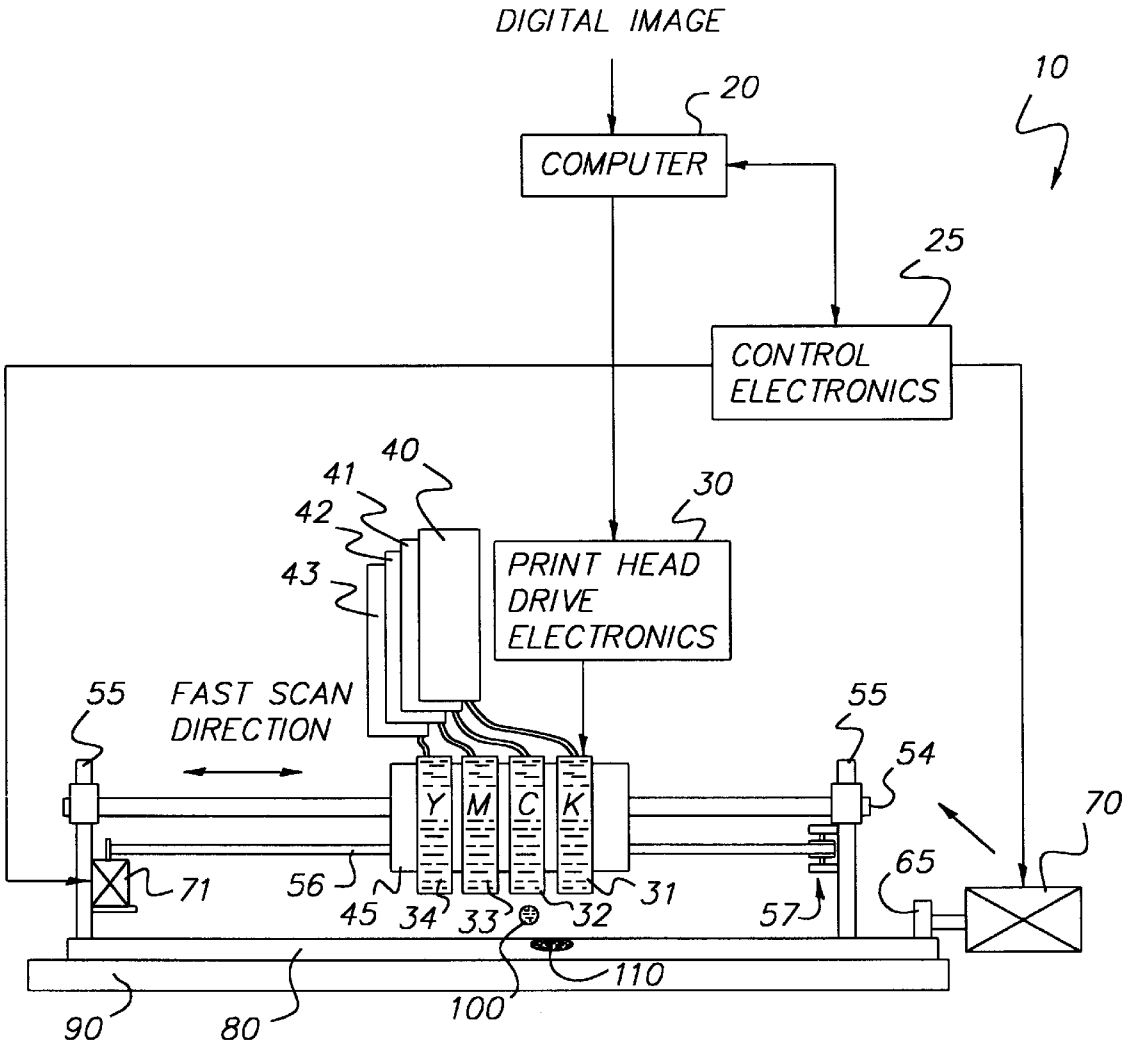
FIG. 1 is a partial front view of the ink jet printing apparatus in the present invention diagramatically showing the control electronics.
Figure 2:
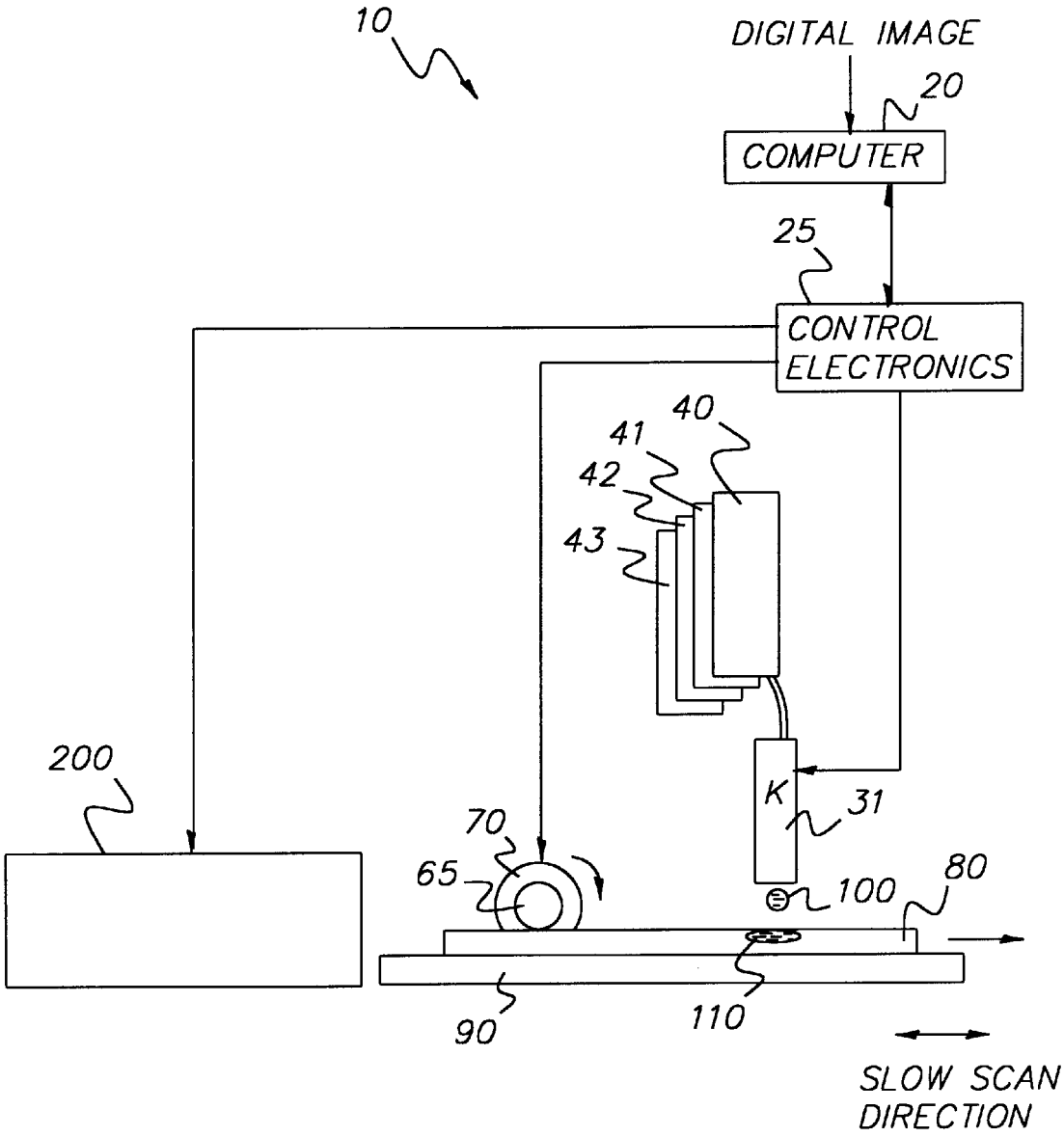
FIG. 2 is a partial side view of the ink jet printing apparatus of FIG. 1.

Referring to FIG. 1, an ink jet printing apparatus 10 in accordance to the present invention includes a computer 20, control electronics 25, print head drive electronics 30, ink jet print head 31–34 respectively for printing black ink (K), cyan ink (C), magenta ink (M), and yellow ink (Y), a plurality of ink reservoirs 40–43 for providing the color inks to the print heads 31–34. As described herein, the term "colorant" will be understood to include inks such as pigmented or dye based materials. The colored inks can also include more than one concentration for each color (e.g. cyan and magenta), and green, orange, gold and other colors. The ink jet printing apparatus 10 further includes a receiver transport motor 70 and a roller 65 for transporting an ink receiver 80 across a platen 90 past the ink jet print heads 31–34. The ink receiver 80 can be provided in the form of a web supplied from a receiver roller, or in cut sheets, as shown in FIGS. 1 and 2. The print heads 31–34 are fixed to a holder 45. The print heads 31–34 and the holder 45 are translated by a belt 56, a pulley mechanism 57, and a print head translating motor 71 along the gliding rail 54 in the fast scan direction (as indicated in FIG. 1). The gliding rail 54 is supported by supports 55. The print heads 31–34 can take various forms known in the art, for example, piezo-electric or thermal ink jet print head. The inks stored in the reservoirs 40–43 are supplied to the print heads 31–34, respectively. The receiver 80 is supported by the platen 90.

A digital image is applied to the computer 20. Alternatively, the computer 20 can produce this digital image. The digital image is processed in the computer 20 by image processing algorithms such as tone scale conversion, color mapping and halftoning, all well known in the art. The computer 20 sends electrical signals according to the image data to the print head drive electronics 30 which controls the print heads 31–34 in a conventional manner. During each printing pass, the computer 20 controls the control electronics 25 to operate the receiver transport motor 70 and the print head translating motor 71. Under the control of the computer, the receiver is positioned for a line of pixels of colorant to be formed and then the print head translating motor 71 moves the ink jet print heads 31–34 in a fast scan direction (shown in FIG. 1) and the print head drive electronics 30 operates the ink jet print heads 31–34 so that colorant provided from the reservoirs 40–43 is caused to be delivered as droplets to the receiving surface of the receiver 80. More particularly, the print heads 31–34 transfer ink drops 100 to the receiver 80 during each printing pass, which forms ink spots 110 on the receiver 80. After each printing pass, the receiver 80 is transported by the receiver transport motor 70 under the control of the control electronics 25 in the slow scan direction (FIG. 2). Each printed image is typically formed by a plurality of printing passes.

FIG. 2 shows a partial side view of the ink jet printing apparatus 10 in the present invention. The receiver 80 is placed on the platen 90. The receiver 80 is transported by the receiver transport motor 70 in the slow scan direction. The receiver transport motor 70 includes a roller 65 under the control of control electronics 25. For clarity, only a black ink jet print head is shown in FIG. 2. After each movement along the slow scan direction, the ink jet print heads 31–34 ejects ink drops 100 which forms ink spots 110 on the ink receiver 80, and thereby forming a swath of image pixels along the fast scan direction as described in relation to FIG. 1. A receiver supply device 200 is provided upstream to the receiver transport direction to supply the ink receivers 80 over the platen 90 toward the ink jet print heads 31–34. The ink receiver 80 can be provided in the form of a web supplied from a receiver roller, or in cut sheets. For the web, a cutter (not shown) will be required to cut the ink images printed on the receiver to proper sizes before or after printing.

Figure 3:
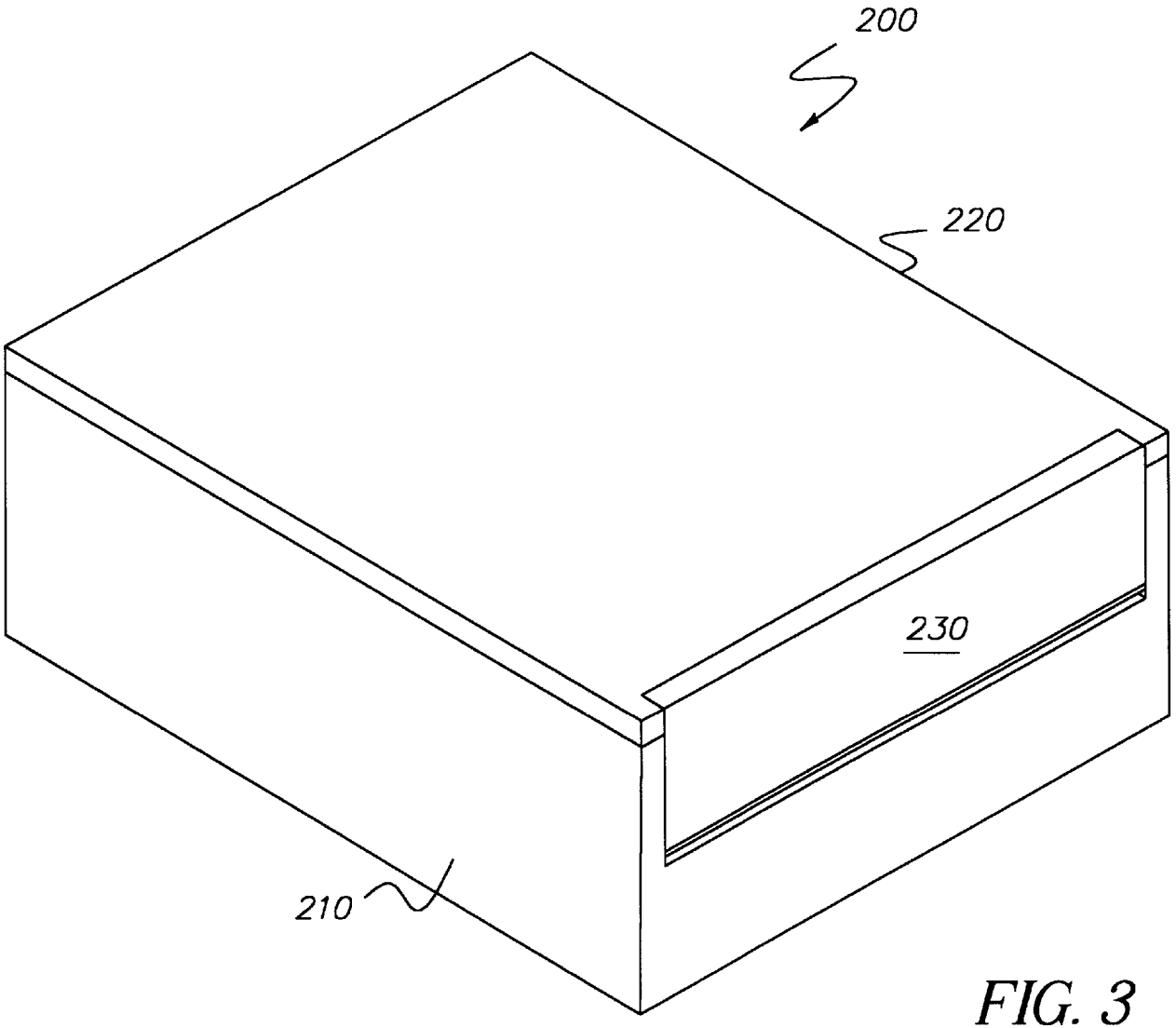
FIG. 3 is a detailed perspective of the receiver supply device of FIG. 2 that is in an enclosed state.
Figure 4:
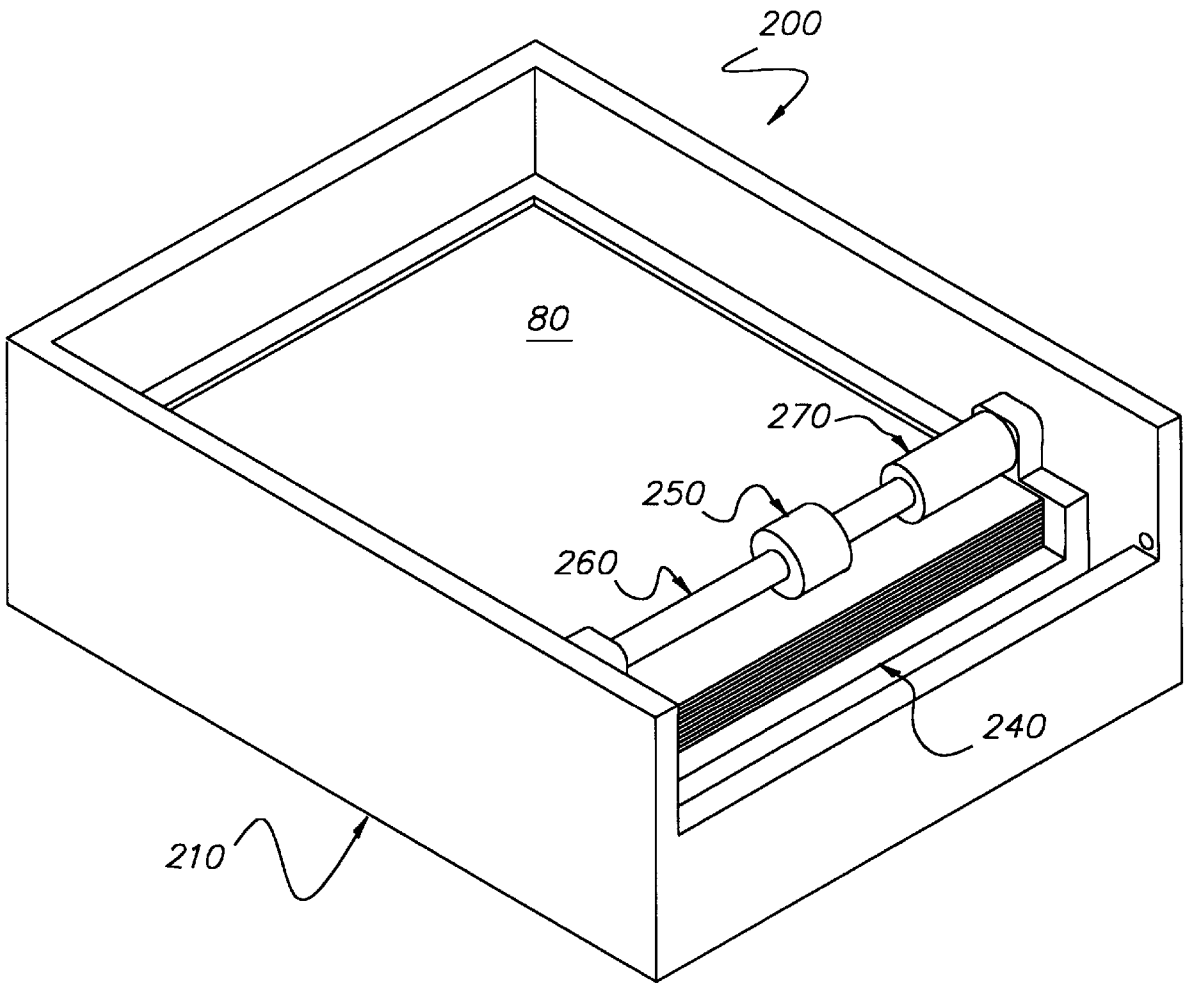
FIG. 4 is a detailed perspective of the receiver supply device without the cover and the door in the front.

FIG. 3 is a detailed perspective of the receiver supply device 200 that is in an enclosed state. The receiver supply device 200 includes a housing 210, a cover 220 and a door 230. The door 230 is shown to be closed so that moisture outside of the receiver supply device 200 can be prevented from coming in contact with the receivers 80. The receiver supply device 200 is shown in more detail without the cover 220 and the door 230 in the front in FIG. 3. Referring to FIG. 4, a receiver tray 240 is contained in the housing 210. A stack of ink receivers 80 is placed in the receiver tray 240. The receivers are pushed up by a spring (not shown) so that the top sheet of the ink receivers 80 is in contact with a picker roller 250. The picker roller 250 is mounted on a shaft 260 that is driven by a motor 270. The motor 270 is controlled by control electronics 25.

Figure 5:
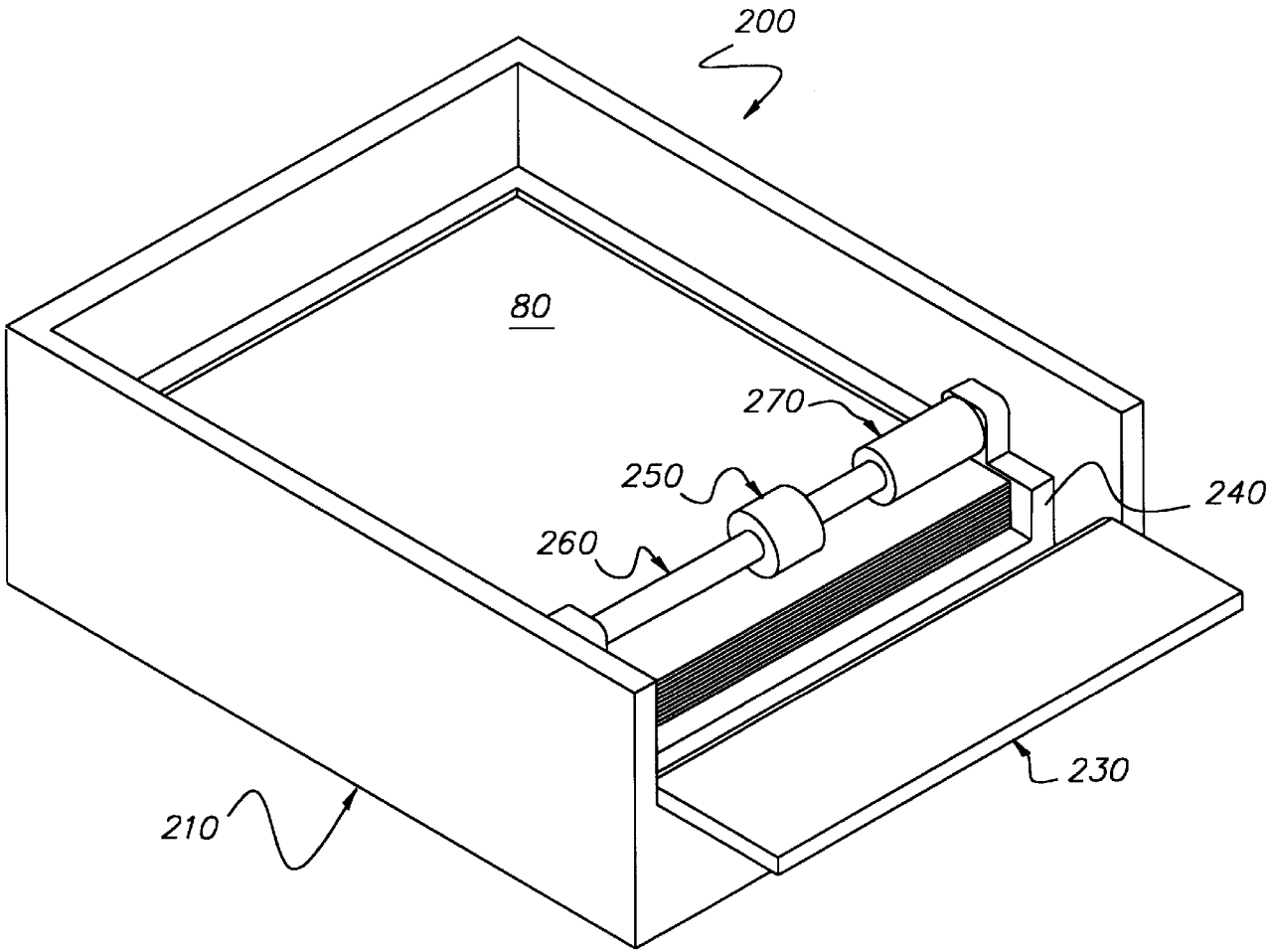
FIG. 5 is a detailed perspective of the receiver supply device wherein the front door is in an open state; and, FIG. 6 is a detailed view of the receiver supply device wherein a receiver is in the process of being transported toward the print heads.
Figure 6:
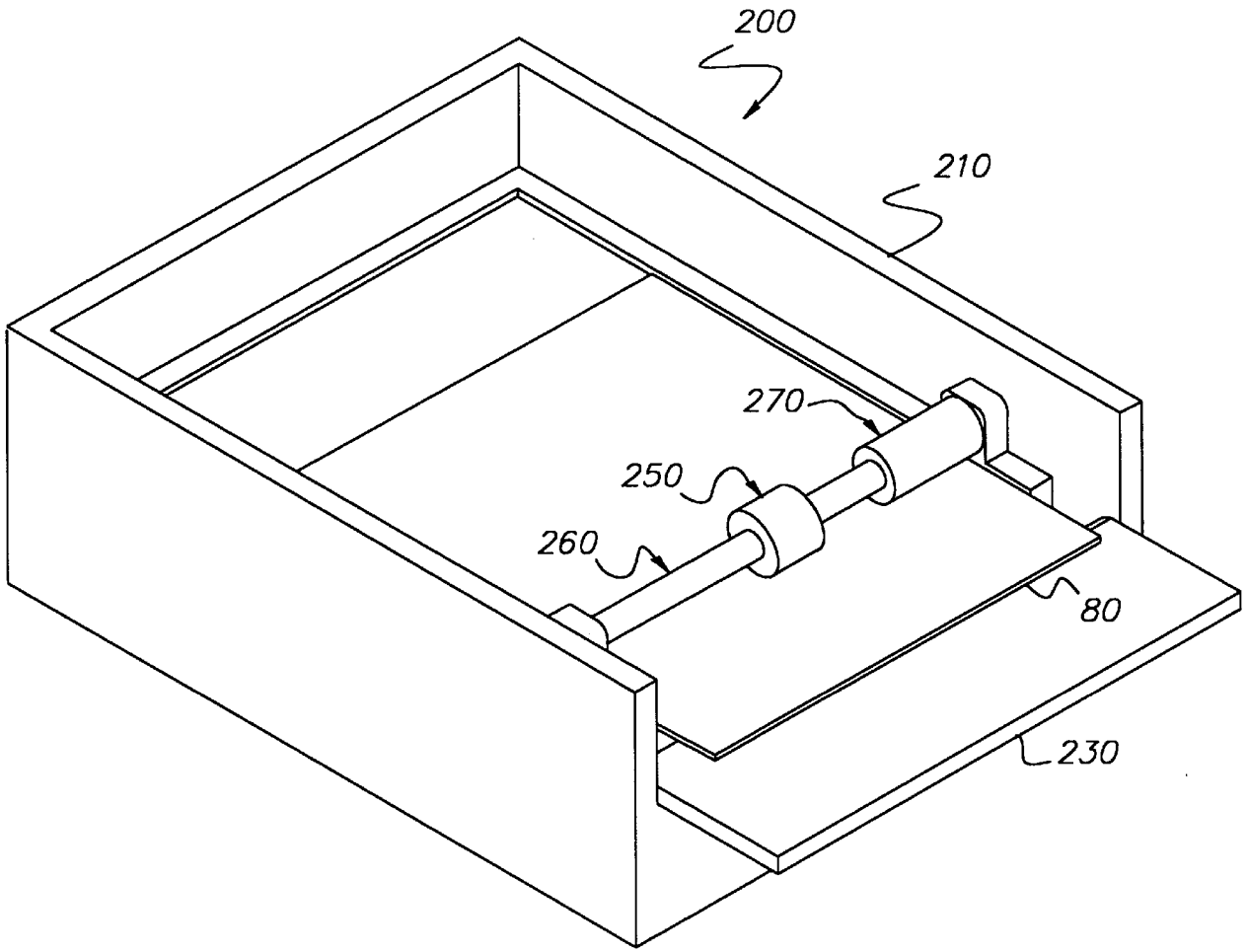

FIG. 5 is another detailed perspective of the receiver supply device 200. The front door 230 is in an open state so that the receivers 80 can be picked by the piker roller 250 and transported out of the receiver supply device 200. FIG. 6 shows an ink receiver 80 in the process of being picked and transported by the picker roller 250 toward the print heads. The computer 20 determines the timing and the sequence for picking the ink receiver 80. The computer 20 then controls the control electronics 25 to activate the motor 270 which rotates the shaft 260 and thereby picker roller 250. Although not shown in FIG. 5 for clarity, as it is well known in the art, the stack of ink receivers 80 are usually stopped by a wall in the front so that only one sheet of ink receiver 80 is picked up at each time. Sometimes, it is also preferred that corner nails can also be provided at the front corners of the receiver tray 240 for separating the top sheet of ink receiver 80 from the rest of ink receiver sheets in a stack. After the ink receiver is transported out of the receiver supply device 200, the door 230 is closed so that the ink receivers 80 are sealed off from the ambient environment.

With the receiver supply device 200 sealed off from the ambient environment to slow down or prevent the inflow of moisture to the receivers, the moisture concentration can be further reduced by placing drying agent in the receiver supply device 200. Some examples of drying agents include sodium carbonate, sodium sulfate, calcium chloride, zinc chloride, calcium sulfate, silica gel, calcium oxide, and synthetic aluminosilicates. The drying agent can be stored in a bag that is porous to the environment so that moisture can be effectively absorbed. Since the receiver supply device 200 is sealed off from the ambient environment, a small amount (e.g. 10 gram) of drying agent can typically last a long period of time. A user can easily replace the used drying agent by a fresh batch of drying agent. The frequency of the replacement and the amount of each replacement can be adjusted depending on the frequencies of the printing as well as the ambient environment.

It is understood that additional drying devices such as heater(s) and fan(s) can be added to the receiver supply device to further reduce the moisture level in the receiver supply device 200. Such heaters and fans can be controlled by the control electronics 25. A humidity sensor can also be provided in the receiver supply tray for detecting the humidity conditions for activating the fans and the heaters.

An advantage of this invention is that the drying of ink drops on the receiver is greatly improved because the receiver is dryer. As a result, image artifacts such as coalescence and inter-color bleeding are reduced. With the increased drying rate, the receivers with freshly printed ink images can be stacked in much shorter time frame after printing. That is, the system printing productivity is increased.

Another advantage of this invention is that the printing performance is less variable relative to different ambient environments. For example, the environment of a printer can vary from an air conditioned room to outside tropical atmosphere (e.g. in a theme park in Florida). The present invention provides consistent printing performance and long receiver storage time in a printer.

A further advantage of the present invention is that the surfaces of the ink receivers are kept dry so that the friction properties of the surfaces under a drive roller (such as rollers 65 and 250) are insensitive to the environmental humidity changes. As a result, the receiver transport is more robust.

The invention has been described in detail with particular reference to certain preferred embodiments thereof, but it will be understood that variations and modifications can be effected within the spirit and scope of the invention.

PARTS LIST

10 ink jet printing apparatus
20 computer
25 control electronics
30 print head drive electronics
31 ink jet print head
32 ink jet print head
33 ink jet print head
34 ink jet print head
40 ink reservoir
41 ink reservoir
42 ink reservoir
43 ink reservoir
45 holder
54 gliding rail
55 support
56 belt
57 pulley mechanism
65 roller
70 receiver transport motor
71 print head translating motor
80 ink receiver
90 platen
100 ink drop
110 ink spot
200 receiver supply device
210 housing
220 cover
230 door
240 receiver tray
250 picker roller
260 shaft
270 motor

What is claimed is:

1. Apparatus for forming an image on a receiver in response to a digital image, comprising:

a) print head means responsive to the digital image for transferring colorant to the receiver;

b) a receiver supply device comprising an enclosure having a closed state and means for storing the receiver in a humidity controlled environment and an open state allowing removal of the receiver; and, c) a receiver transport mechanism for moving the receiver from the enclosure when in its open state to a position where the print head means transfers colorant to the receiver outside of the enclosure to form an image on the receiver.

2. The apparatus of claim 1 wherein the receiver supply device includes a door that can be closed for keeping moisture outside and that can be opened for transporting a receiver out of the receiver supply device.

3. The apparatus of claim 1 wherein the receiver is provided in cut sheets.

4. The apparatus of claim 1 wherein the receiver is provided in the form of a web.

5. The apparatus of claim 1 wherein the receiver supply device includes drying agents.

6. The apparatus of claim 5 wherein the drying agents include sodium carbonate, sodium sulfate, calcium chloride, zinc chloride, calcium sulfate, silica gel, calcium oxide, and synthetic aluminosilicates.

7. The apparatus of claim 1 wherein the receiver supply device includes a receiver tray for storing the receivers.

8. The apparatus of claim 1 wherein the receiver supply device includes a picker roller for picking and transporting the receiver.

9. Ink jet printing apparatus for forming an image on an ink receiver in response to a digital image, comprising:

a) at least one ink jet print head responsive to the digital image for forming an ink image on the ink receiver; and b) a receiver supply device comprising an enclosure having a closed state and means for storing the ink receiver(s) in a humidity controlled environment and an open state allowing removal of the ink receiver; and, c) a receiver transport mechanism for moving the ink receiver from the enclosure when in its open state to a position where the print heads transfers ink drops to the ink receiver outside of the enclosure to form an ink image on the receiver.

* * * * *